US006675979B2

(12) United States Patent
Taylor

(10) Patent No.: US 6,675,979 B2
(45) Date of Patent: Jan. 13, 2004

(54) FURNITURE ASSEMBLY SYSTEM

(76) Inventor: Gregory Albert Taylor, 1900 W. 49th St., Minneapolis, MN (US) 55409

( * ) Notice: Subject to any disclaimer, the term of this patent is extended or adjusted under 35 U.S.C. 154(b) by 0 days.

(21) Appl. No.: 10/153,559

(22) Filed: May 21, 2002

(65) Prior Publication Data

US 2003/0066813 A1 Apr. 10, 2003

Related U.S. Application Data

(60) Provisional application No. 60/292,346, filed on May 21, 2001.

(51) Int. Cl.[7] ..... A47B 43/00

(52) U.S. Cl. ..... 211/186; 403/294; 403/354; 403/DIG. 13; 108/153.1; 108/158.12; 312/271; 211/135; 211/183

(58) Field of Search ..... 211/134, 135, 211/186, 189, 194, 183, 27, 126.16, 90.04, 188, 187, 184; 108/60, 180, 150, 153.1, 154–156, 158.12, 158.13; 312/242, 257.1, 265.5, 271; D6/491, 495; 248/188.1–188.9; 403/DIG. 11–13, 315–318, 292, 294, 345, 353

(56) References Cited

U.S. PATENT DOCUMENTS 2,366,676 A * 1/1945 Rosenthal ..... 108/180
2,486,987 A * 11/1949 Scarlett ..... 297/440.13
2,526,246 A * 10/1950 Leeper ..... 108/101
2,546,812 A * 3/1951 Anderson ..... 108/25
2,825,101 A * 3/1958 Rubenstein ..... 403/217
3,788,700 A * 1/1974 Wartes ..... 297/440.13
4,055,924 A * 11/1977 Beaver, Jr. ..... 52/262
4,140,065 A * 2/1979 Chacon ..... 108/156
4,153,311 A * 5/1979 Takahashi ..... 312/107
4,191,113 A * 3/1980 Hogberg ..... 108/157.16
4,232,916 A * 11/1980 Correia ..... 312/107
4,282,665 A * 8/1981 Fletcher et al. ..... 37/457
5,279,232 A * 1/1994 Gollick ..... 108/109
5,832,689 A * 11/1998 Curll ..... 52/656.9
5,964,360 A * 10/1999 Hwang ..... 211/186
6,126,022 A * 10/2000 Merkel ..... 211/135

* cited by examiner

*Primary Examiner*—Daniel P. Stodola
*Assistant Examiner*—Jennifer E. Novosad
(74) *Attorney, Agent, or Firm*—Patterson, Thuente, Skaar & Christensen, P.A.

(57) ABSTRACT

A furniture assembly system utilizes upright members having a pair of protruding hook portions that cooperate with a similar pair of hook portions of another upright member and mutually interconnect through slots in a shelf to hold the shelf in place. A plug inserts into an aperture formed by the interconnecting hook portions to hold the upright members in place and secondarily to provide further support to the shelf.

14 Claims, 7 Drawing Sheets

FURNITURE ASSEMBLY SYSTEM

RELATED APPLICATIONS

This application claims the benefit of U.S. Provisional Application No. 60/292,346, filed May 21, 2001, which is incorporated herein by reference.

FIELD OF THE INVENTION

The present invention relates to devices wherein upright, rigid, planar supporting members have the structure to support a horizontal surface from opposite sides of the surface and project toward each other. In particular, the present invention relates to a free standing furniture system that is disassemblable and reassemblable without using permanent or threaded or similar fasteners.

BACKGROUND OF THE INVENTION

Furniture is often permanently assembled using glue, threaded fasteners, and other kinds of fasteners that are intended to be reasonably permanent. This method of assembly is generally desirable when the furniture will be used in one location for an extended period of time and when limited flexibility for adding on or changing components is not important. A disadvantage of this kind of furniture is that it is difficult to easily disassemble and reassemble, move, and store. Consequently, non-permanently assemblable furniture that can be readily assembled, disassembled, and re-assembled is very useful in certain situations. Adults may use this kind of furniture in temporary work settings where furniture is needed to hold or help organize items. Students may use this kind of furniture in temporary living situations such as apartments or dorm rooms that must be vacated at the end of each school year. Even children can use this kind of furniture, which may provide some sense of self-determination in that it is easy to tear down and set-up when children want to rearrange their bedroom or play areas.

Reassemblable furniture is well known to those in the art. Examples of this kind of furniture include Scarlett, U.S. Pat. No. 2,486,987, Fabricated Chair; Leeper, U.S. Pat. No. 2,526,246, Self-Locking Structure; Anderson, U.S. Pat. No. 2,546,812, Knockdown Table Furniture; Beaver, Jr., U.S. Pat. No. 4,055,924, Inexpensive and Disassemblable Structural Units; Wartes, U.S. Pat. No. 3,788,700, Multifunctional Pegged Furniture; Chacon, U.S. Pat. No. 4,140,065, Modular Furniture; and Hogberg, U.S. Pat. No. 4,191,113, Table or Stool of Separable Components.

In particular, shelves or bookcases have been made to be assemblable, such as Takahashi, U.S. Pat. No. 4,153,311, Sectional Unit Furniture Assembly and Merkel, U.S. Pat. No. 6,126,022, Component Shelf System, wherein interlocking slots are used, or tabs positioned through slots perpendicularly and secured in place by securing bars or wedge members positioned through the tabs. Other shelves or bookcases use only tabs positioned through slots and secured by wedges, wedge bars, or tapping pegs positioned through the tabs, such as the furniture disclosed in Rosenthal, U.S. Pat. No. 2,366,676, Knock-Down Shelving Structure; Schneider, U.S. Pat. No. 2,595,002, Display Stand; and Gollick, U.S. Pat. No. 5,279,232, Modular Shelving Interconnection Assembly. Each of these shelving units or bookcases uses upright side pieces that are one integral or unitary piece of wood or other similar material. Thus, the tabs must be at the ends of the shelves, and the wedges or other holding means generally cannot be used to support the shelves. In Rubenstein, U.S. Pat. No. 2,825,101, Joint Construction, the side pieces of the shelves are comprised of several pieces. These side pieces, however, are not interlocking; rather they abut the tops and bottoms of the shelves and held in place merely by wedges inserted through slots in the shelves. These wedges likewise cannot offer additional support to the shelves.

It would be advantageous to have shelves or bookcases that include side members that are not unitary, so that the furniture is expandable and different side piece components and shelves can be intermixed for different appearances, and whereby the side members are interlocking in three dimensions to give the furniture additional stability. It would also be advantageous if the means to hold the side members and shelves in place could be used to help support the shelves when the furniture is assembled.

SUMMARY OF THE INVENTION

A furniture assembly system utilizes upright members having a pair of protruding hook portions that cooperate with a similar pair of hook portions of another upright member and mutually interconnect through slots in a shelf to hold the shelf in place. A plug inserts into an aperture formed by the interconnecting hook portions to hold the upright members in place and secondarily to provide further support to the shelf.

The present invention provides a furniture assembly system. The furniture is reassemblable and can be used in a myriad of situations by persons of all ages. The system is easy to assemble and does not use permanent or threaded or similar fasteners so that tools are unnecessary for assembling a system. The sides of the system are not unitary, so that the furniture is expandable and different upright members and shelves can be intermixed. The upright component members have hook portions to cooperatively and mutually interconnect to give added stability to the system, which hook portions have fluted surfaces where they interconnect to offer additional lateral stability. The system uses plugs to hold the upright members in place, and the position of upright members is not limited only to the ends of the shelves.

A preferred embodiment of a free standing shelf assembly system comprises at least one shelf and upright members including at least two foot members and at least two side members, the top side members being crown members and the other side members being middle members, with each shelf and upright member having opposing planar surfaces. The shelf has top and bottom opposing planar surfaces, two opposing ends, and at least one slot approximate each end. A foot member is positioned at each end of the shelf and positioned along a plane approximately perpendicular to the shelf and aligned with the respective at least one slot. A foot member has a top surface to engage the bottom surface of the shelf and at least one lower hook portion that is constructed and arranged to extend through the respective slot. A side member is likewise positioned at each end of the shelf so that its planar surfaces align with those of the respective foot member. Each side member has a bottom surface to engage the top surface of the shelf and at least one upper hook portion extending through the respective slot to cooperatively and mutually interconnect with the respective lower hook portion of the respective foot member, whereby an aperture is formed. A plug is positions in the aperture to hold the interconnecting upright members in place.

In general, a preferred embodiment of the joint construction and arrangement comprises separable first, second and third planar, joined members, wherein each member has opposing planar surfaces and wherein the planar surfaces of the second and third members are aligned with each other along a plane approximately perpendicular to the first member. The first member has at least one slot therethrough aligned with the second and third members. The second and third members respectively engage opposite surfaces of the first member and have hook portions extending through the slot to engage each other in a cooperative and mutually interconnecting manner that forms an aperture. A plug is positioned in the aperture to hold the second and third members in place, and consequently the first member as well.

To assemble a preferred embodiment of the joint, a first planar member, having opposing planar surfaces and having at least one slot therethrough, and second and third planar members, each having opposing planar surfaces and a hook portion, are provided. The planar surfaces of the second and third members are aligned with each other along a plane approximately perpendicular to the first member and with the at least one slot and positioned to engage opposite surfaces of the first member. The hook portion of each the second and the third members are extended through the at least one slot to engage the hook portion of the other in a mutually interconnecting manner, and a plug is provided and inserted between the hook portions of the second and third members to hold them in place.

DESCRIPTION OF THE PREFERRED EMBODIMENT

Figure 1A:
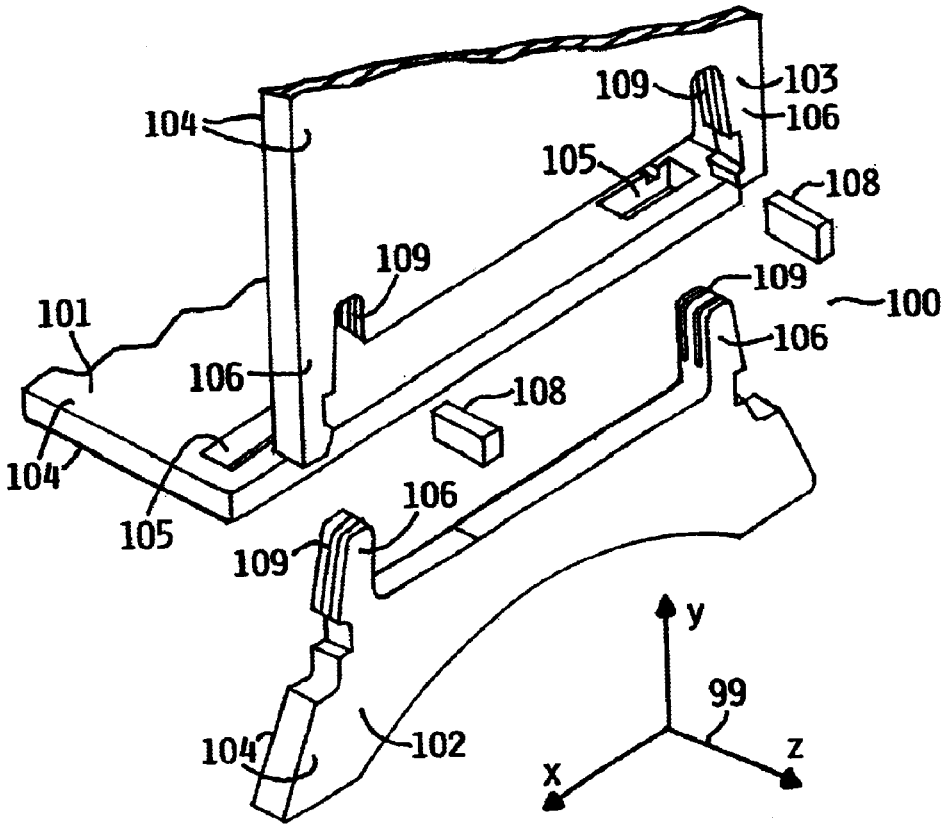
FIGS. 1A–B are close-up views of the joint construction and arrangement used to assemble a shelf furniture assembly system.
Figure 1B:
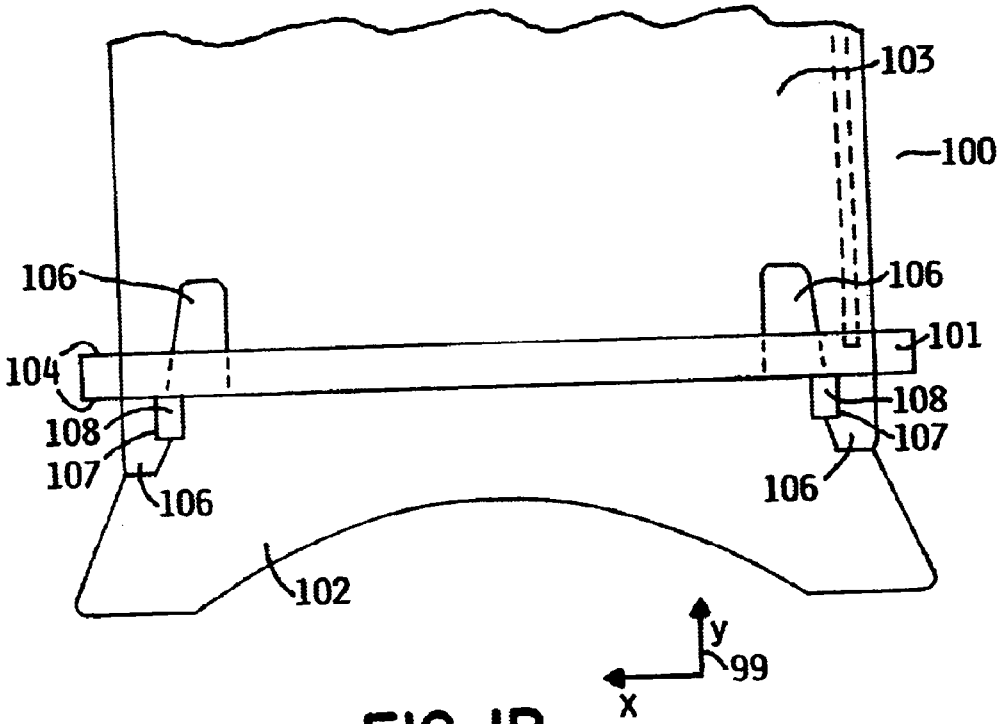

The preferred embodiment relates to a furniture assembly system in accordance with the present invention. In particular, the preferred embodiment is a free standing shelf or bookcase, although those skilled in the art are aware that the present invention can be used to for many different kinds of furniture such as chairs or tables. As shown in FIGS. 1A–B, the focal point of the present invention and the shelf assembly system is the joint construction and arrangement. An x-y-z coordinate system 99 is illustrated for reference purposes. The joint is used to hold a first member 101 in place by a second member 102 and a third member 103. The first member 101, second member 102, and third member 103 are all planar and have opposing planar surfaces 104. The first member 101 has a slot 105, and the planar surfaces 104 of the second member 102 and the third member 103 are aligned with each other along a plane approximately perpendicular to the first member 101 and with the slot 105 in the first member 101. The second member 102 and the third member 103 have a hook portion, and as later shown in FIGS. 2-5, when the joint is assembled, the second member 102 and the third member 103 engage opposite surfaces of the first member 101, and the hook portion 106 of the second member 102 and the third member 103 extend through the slot of the first member 101 to engage the hook portion 106 of the other in a mutually interconnecting manner to form an aperture 107. The hook portions 106 of the second 102 and third 103 members each have interlocking, fluted surfaces 109 where they mutually interconnect. A plug 108 is positioned in this aperture 107 to hold the second member 102 and third member 103 in place. Preferably, the only manner to extend the hook portions 106 through the slot 105 is in a direction perpendicular to the slot 106. Consequently, positioning the plug 106 in the aperture 107 prevents movement of the second member 102 and the third member 103 without movement of the other, which is engaged against a planar surface of the first member 101. The plug 108 may be made of wood and preferably of rigid, slightly resilient plastic, rubber, or similar material. The plug 108 is generally cylindrical to match the aperture 107 which is round and extends between the opposing planar surfaces of the second member 102 and the third member 103. If desirable, the plug 108 can be made longer to extend under and support the first member 101.

Figure 2:
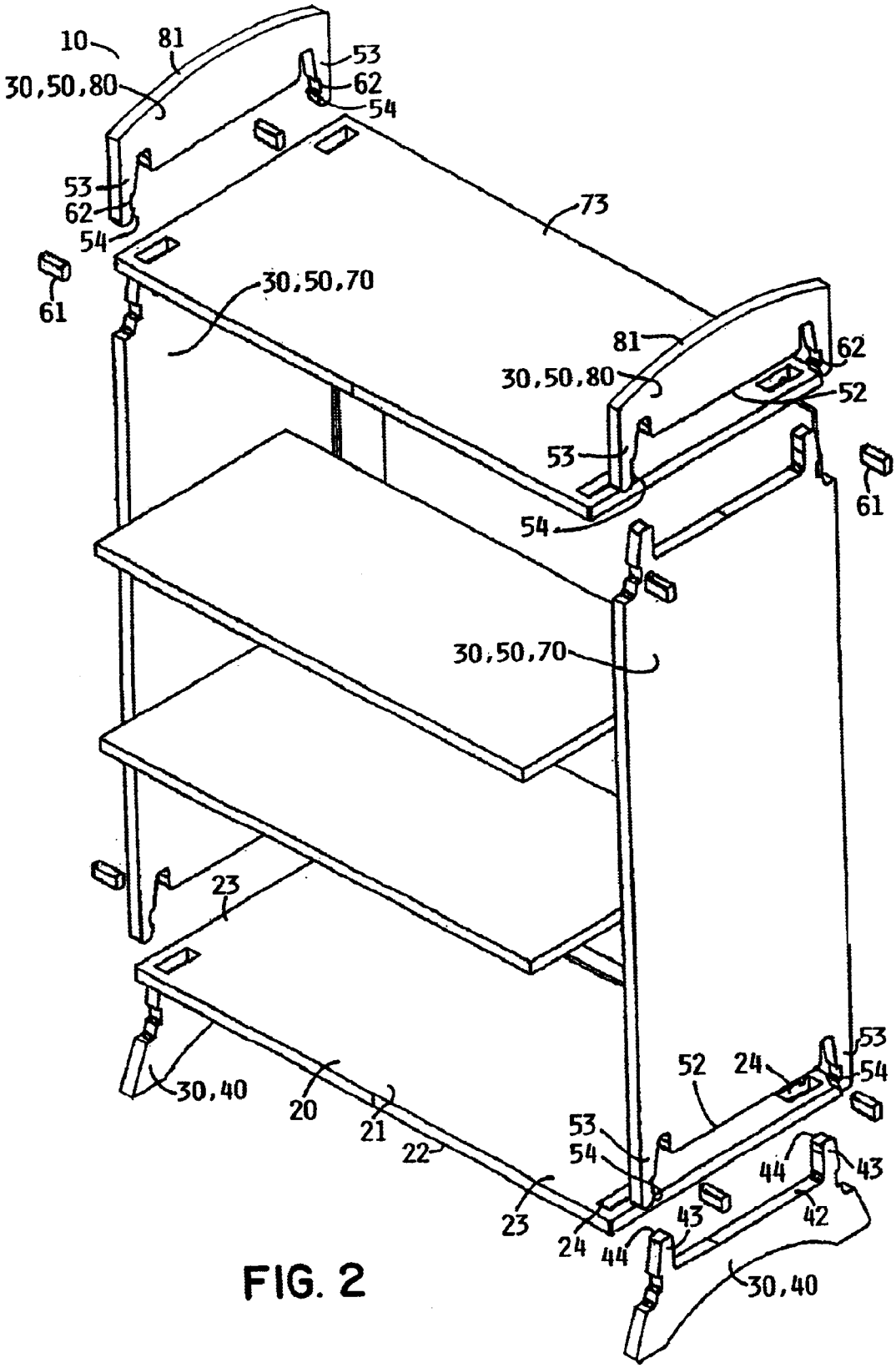
FIG. 2 is an exploded view of a shelf furniture assembly system.

FIG. 2 is an exploded view of the shelf assembly system 10. The shelf system 10 includes at least one shelf or first shelf 20 and preferably a second shelf 73 or more. Each shelf is horizontally oriented. Each shelf, and particularly the first shelf 20 has a top planar surface 21 opposite a bottom planar surface 22, two opposing ends 23, and at least one slot 24, although preferably two slots 24, approximate each end 23. The slots 24 preferably are positioned parallel to the ends 23 of each shelf.

Figure 4:
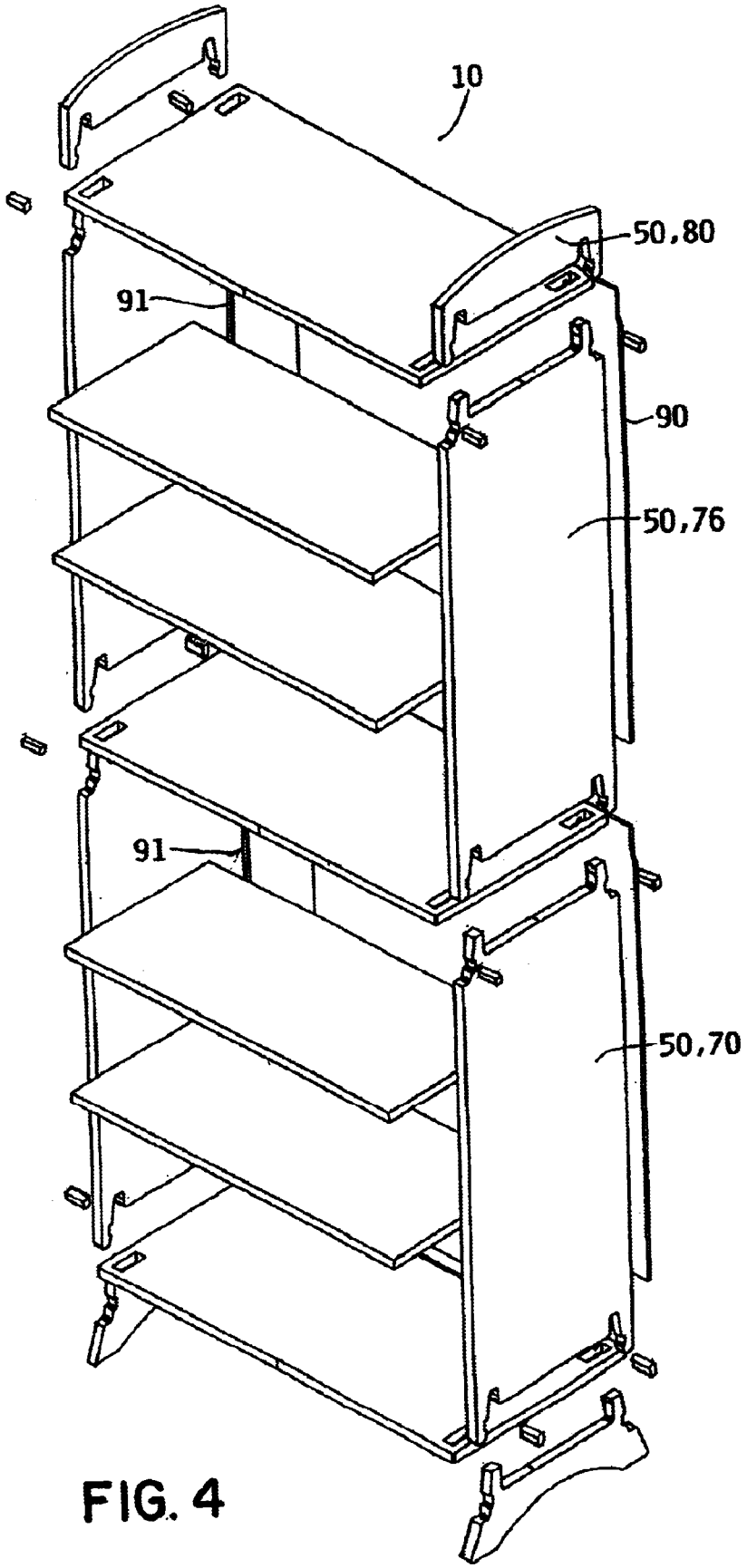
FIG. 4 is an illustration of a shelf furniture assembly system demonstrating the feature of stacking.
Figures 5A, 5B, 5C, 5D:
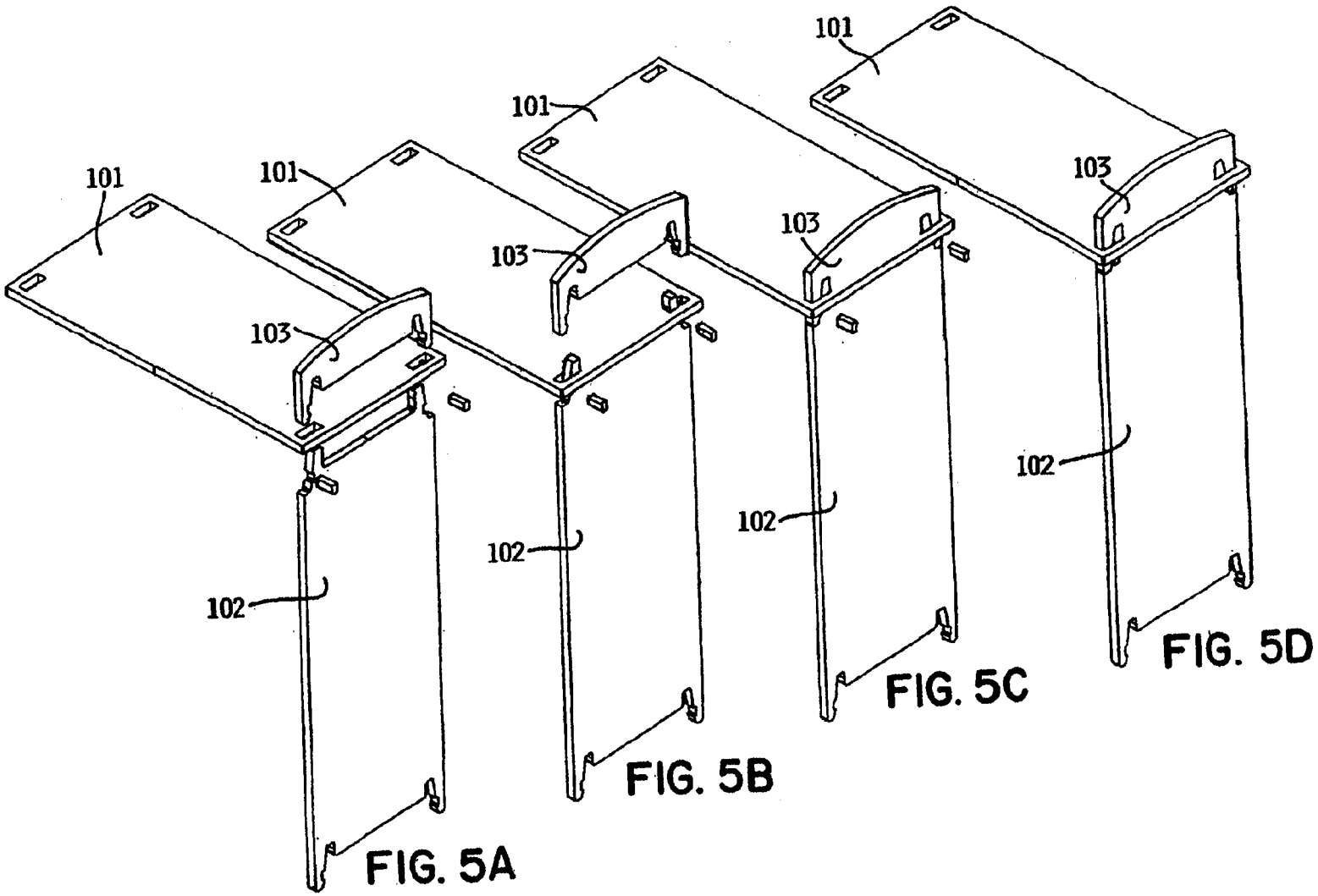
FIGS. 5A–D are an illustration of assembling a joint used to assemble a shelf furniture assembly system.
Figure 6:
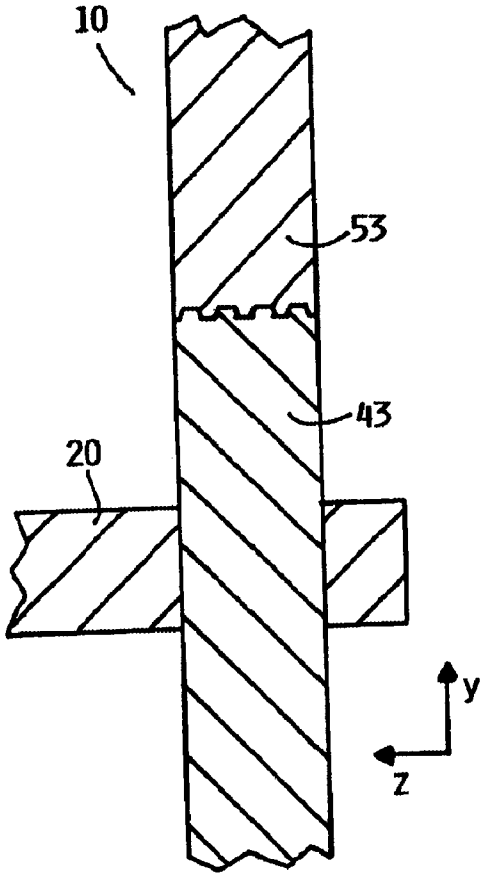
FIG. 6 is a close-up view of interconnecting hook portions.

The shelf system 10 further includes upright members 30 including foot members 40 and side members 50, which side members are either middle members or crown members 80. Like shelves 20, upright members 30 are planar and have opposing planar surfaces. A shelf system 10 preferably has two foot members 40 upon which the shelf system 10 rests. Each foot member 40 has a top surface 42 and an upwardly extending lower hook portion 43 for interconnecting with a side member 50, preferably a middle member 70. The interconnecting surfaces are at least partially ribbed or fluted 44 to provide additional lateral stability in the z direction. FIG. 6 shows a close-up of interconnecting hook portions. A side member has at least a bottom surface 52, and downwardly extending upper hook portion 53, and fluted surfaces where the hook portion 53 interconnects. Side members 50 that are also middle members 70 are used to expand the shelf system 10 upwardly and also have a top surface and an upwardly extending lower hook portion 72, while crown members 80 have a smooth, curvilinear top surface 81. Crown members 80 are used as the top most side member 50 to give a shelf system 10 a finished look. A shelf system 10 preferably has two middle members 70 and two crown members 80, although as shown in FIG. 4, shelf systems 10 may have two, four, or even more middle members 70, depending on the strength of the materials used.

The region where engagement occurs between shelves and upright members includes two pair of cooperating or mutually interconnecting hook portions, two upper hook portions and two lower hook portions extending through two respective slots. Preferably, each hook portion has a receiving area having fluted surfaces for securely interconnecting. Each hook portion also has a recess 62 configured to align with the recess 62 of the other cooperating hook portion. When cooperating pairs of hook portions are interconnected, these recesses 62 form an aperture (not shown) into which a plug 61 is inserted to hold the upright members in place. The plug 61 is longer than the distance between the opposing surfaces of an upright member so that they can extend under and support a shelf. The area between each pair of cooperating hook portions is flat and recessed so that it firmly engages a shelf between interconnected upright members. In this manner, once a plug is inserted, the joint is held fast.

Figure 3A:
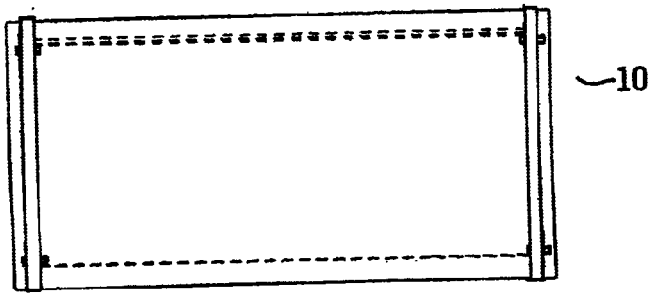
FIGS. 3A–C are top, side, and front views of a shelf furniture assembly system.
Figure 3B:
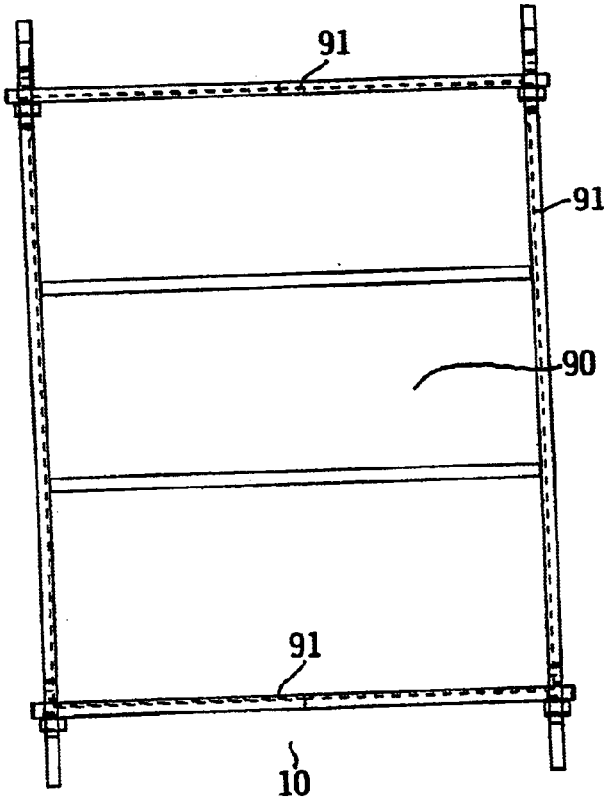
Figure 3C:
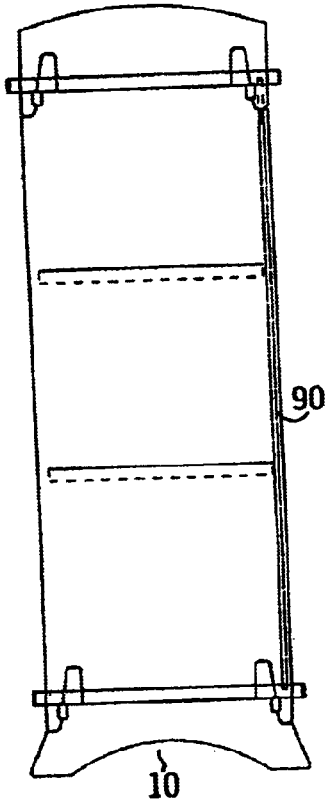
Figure 7B:
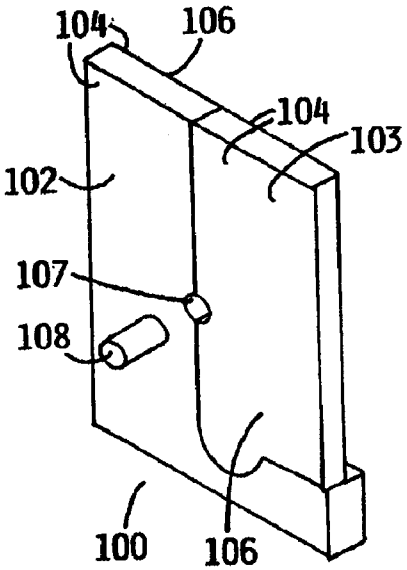
FIGS. 7A–C are alternative embodiments of the joint construction and arrangement.
Figure 7A:
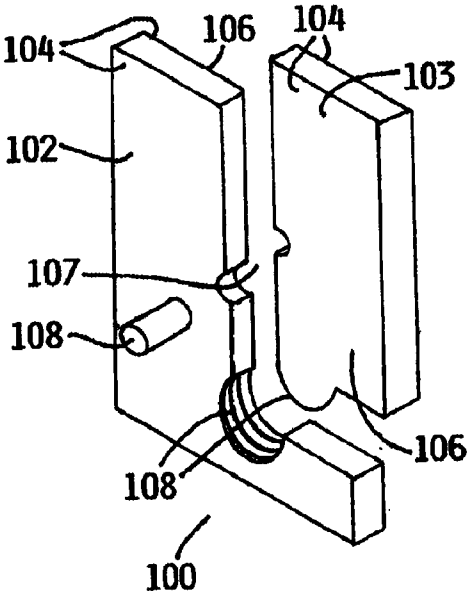
Figure 7C:
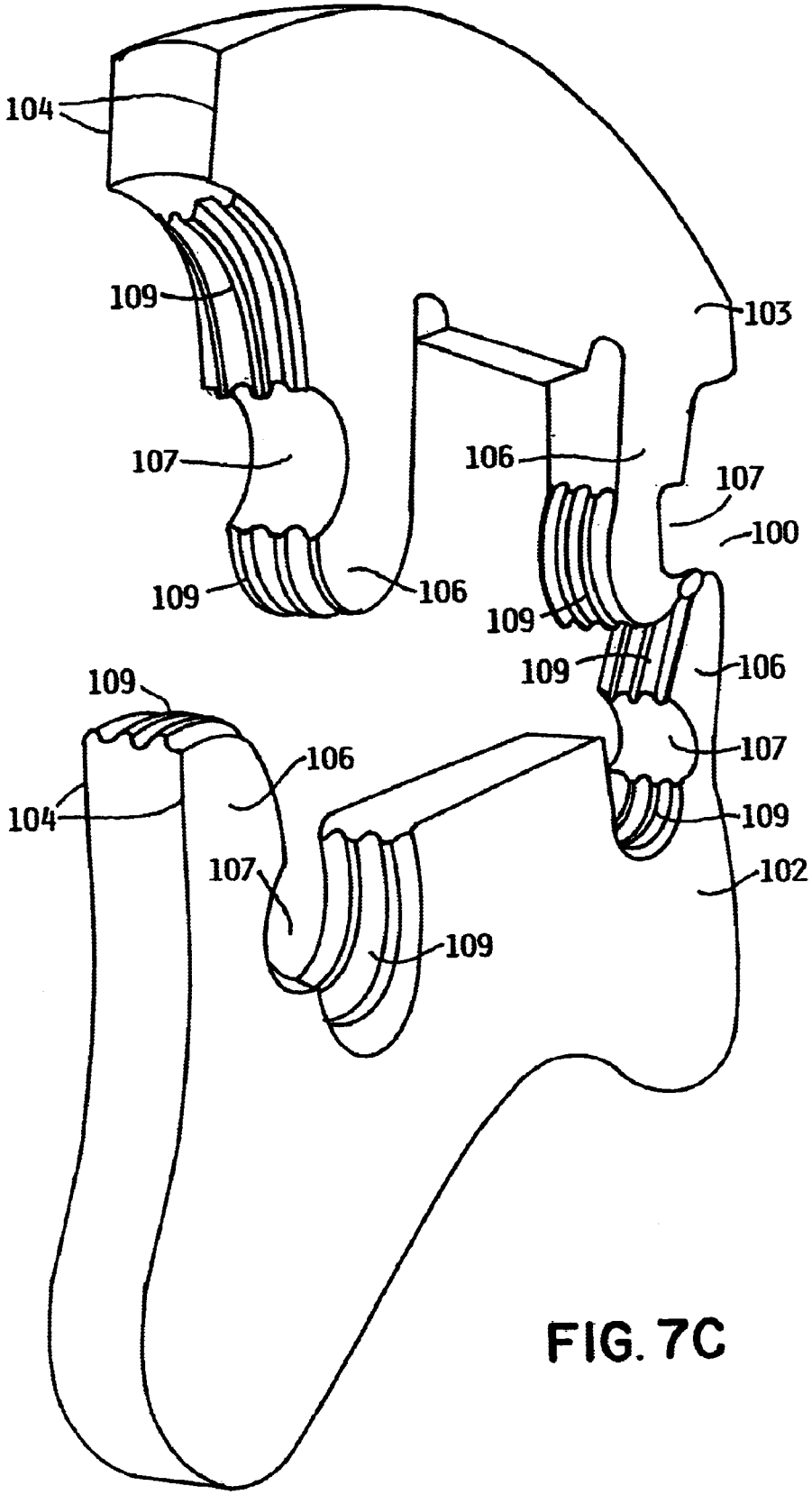

As shown in FIGS. 3A–C, edges of rear backing panels 90 may be received in channels 91 in the side members and shelves. A rear backing panel provides additional rigidity to the assembly to resist shear stresses. Additional shelves may be supported by horizontal slots or pegs in side members. Doors may also be added to a shelf assembly system. FIGS. 7A–C are alternative embodiments of the joint construction and arrangement.

As shown in FIGS. 5A–D, to assemble a preferred embodiment of the joint, a first planar member 101, having opposing planar surfaces and having at least one slot therethrough, and second 102 and third 103 planar members, each having opposing planar surfaces and a hook portion, are provided. The planar surfaces of the second and third members are aligned with each other along a plane approximately perpendicular to the first member and with the at least one slot and positioned to engage opposite surfaces of the first member. The hook portion of each the second and the third members are extended through the at least one slot to engage the hook portion of the other in a mutually interconnecting manner, and a plug is provided and inserted between the hook portions of the second and third members to hold them in place.

Although the preferred embodiment of the furniture assembly system has been described herein, numerous changes and variations can be made and the scope of the invention is intended to be defined by the claims herein.

What is claimed is:

1. A free standing shelf assembly system, comprising:

a first shelf having top and bottom opposing planar surfaces, two opposing ends; and at least one slot proximate each end;

a foot member positioned at each end of the first shelf along a plane approximately perpendicular to the first shelf and aligned with the respective at least one slot, having opposing planar surfaces and a top surface to engage the bottom surface of the first shelf, and having at least one lower hook portion extending through the respective at least one slot;

a side member positioned at each end of the first shelf and having opposing planar surfaces aligned with those of the respective foot member, wherein the side member has a bottom surface to engage the top surface of the first shelf and at least one upper hook portion extending through the respective at least one slot to mutually interconnect with the respective lower hook portion of the foot member, whereby an aperture is formed;

a plug positioned in each aperture to hold the respective foot member and side member in place.

2. The free standing shelf assembly system of claim 1, wherein the hook portions of the foot members and the side members have interlocking, fluted surfaces where they interconnect.

3. The free standing shelf assembly system of claim 1, wherein each slot is positioned parallel to the respective end of the first shelf.

4. The free standing shelf assembly system of claim 1, wherein the side members are middle members also having a top surface and at least one lower hook portion to engage a second shelf constructed and arranged similarly to the first shelf.

5. The free standing shelf assembly system of claim 1, where the side member is a crown member having a smooth, curvilinear top surface.

6. The free standing shelf assembly system of claim 1, further comprising a back panel, wherein the back panel has edges and the side members have channels constructed and arranged to insert the edges therein to hold the back panel in place.

7. The free standing shelf assembly system of claim 1, further comprising at least one door.

8. A joint construction and arrangement, comprising:

separable first, second, and third planar, joined members, each member having opposing planar surfaces, wherein the planar surfaces of the second and third members are aligned with each other along a plane approximately perpendicular to the first member, wherein the first member has at least one slot therethrough aligned with the second and third members, wherein the second and third members respectively engage opposite surfaces of the first member and each second and third member has a hook portion extending through the at least one slot to engage the hook portion of the other second and third member in a mutually interconnecting manner to form an aperture; and a plug positioned in the aperture to hold the second and third members in place.

9. The joint construction and arrangement of claim 8, wherein the hook portions of the second and third members have interlocking, fluted surfaces where they mutually interconnect.

10. The joint construction and arrangement of claim 8, wherein the plug is comprised of a rigid resilient material.

11. The joint construction and arrangement of claim 8, wherein the plug extends beyond the second and third members to support the first member.

12. A joint construction and arrangement, comprising:

separable first, second, and third planar, joined members, each member having opposing planar surfaces, wherein the planar surfaces of the second and third members are aligned with each other along a plane approximately perpendicular to the first member, wherein the first member has at least one slot therethrough aligned with the second and third members, wherein the second and third members respectively engage opposite surfaces of the first member and each second and third member extends through the at least one slot to engage the other second and third member in a mutually interconnecting manner to form an aperture; and a plug positioned in the aperture to hold the second and third members in place.

13. A joint construction and arrangement, comprising:

separable first, second, and third planar, joined members, each member having opposing planar surfaces, wherein the planar surfaces of the second and third members are aligned with each other along a plane approximately perpendicular to the first member, wherein the first member has at least one slot therethrough aligned with the second and third members, wherein the second and third members respectively engage opposite surfaces of the first member and together have a means extending through the at least one slot for engaging each other in a mutually interconnecting manner; and a means for holding the second and third members in place.

14. A method for assembling a joint used in assembling furniture, comprising:

(a) providing a first planar member having opposing planar surfaces and having at least one slot therethrough;

(b) providing a second planar member and a third planar member, each having opposing planar surfaces and a hook portion;

(c) aligning the planar surfaces of the second and third members with each other along a plane approximately perpendicular to the first member and with the at least one slot;

(d) engaging opposite surfaces of the first member with the second and third members;

(e) extending the hook portion of each the second and the third members through the at least one slot to engage the hook portion of the other in a mutually interconnecting manner;

(f) providing a plug to hold the second and third members in place; and (g) inserting the plug between the hook portions of the second and third members.

* * * * *